United States Patent [19]

Okuda

[11] Patent Number: 4,540,866

[45] Date of Patent: Sep. 10, 1985

[54] INDUCTION HEATING APPARATUS

[75] Inventor: Takao Okuda, Ohtsu, Japan

[73] Assignee: Sanyo Electric Co., Ltd., Moriguchi, Japan

[21] Appl. No.: 556,110

[22] Filed: Nov. 29, 1983

[30] Foreign Application Priority Data

Dec. 3, 1982 [JP] Japan ..... 57-213170

[51] Int. Cl.[3] ..... H05B 6/64; H05B 1/02

[52] U.S. Cl. ..... 219/10.77; 219/10.49 R; 363/21

[58] Field of Search ..... 219/10.77, 10.49 R; 363/21, 24, 135, 96; 323/21, 41, 37, 131

[56] References Cited

U.S. PATENT DOCUMENTS

| | | | |
|---|---|---|---|
| 4,210,792 | 7/1980 | Higuchi et al. | 219/10.49 R |
| 4,211,912 | 7/1980 | Kiuchi et al. | 219/10.77 |
| 4,352,000 | 9/1982 | Fujishima et al. | 219/10.77 |
| 4,356,371 | 10/1982 | Kiuchi et al. | 219/10.77 |
| 4,438,311 | 3/1984 | Tazima et al. | 219/10.49 R |
| 4,467,165 | 8/1984 | Kiuchi et al. | 219/10.77 |

FOREIGN PATENT DOCUMENTS

| | | |
|---|---|---|
| 53-44061 | 11/1978 | Japan . |
| 58-111291 | 7/1983 | Japan . |

*Primary Examiner*—Roy N. Envall, Jr.
*Assistant Examiner*—M. Lateef
*Attorney, Agent, or Firm*—Burns, Doane, Swecker & Mathis

[57] ABSTRACT

An induction heating apparatus which is adapted to stop heating when a load is abnormal and adjust the time period of turning on a switching element of an inverter circuit including an induction heating coil for the load to thereby adjust the input power for heating or the input power for the inverter circuit, so that the signal for controlling the switching element to be on-off is compared with the input of the load or the input of inverter circuit, thereby discriminating normality and abnormality of the load on the basis of the comparison results. Hence, the comparison is carried out under the reference corresponding to the intensity of the input to the load or the input to the inverter circuit, thereby enabling the rapid and reliable detection of abnormal load.

6 Claims, 7 Drawing Figures

INDUCTION HEATING APPARATUS

BACKGROUND OF THE INVENTION

1. Field of the Invention

This invention relates to an induction heating apparatus, and more particularly to an induction heating apparatus which detects abnormality in a case where, although an iron cooking-pot essentially is to be placed as a load on a heating unit, an improper load, such as an aluminum or copper pot or a utensil, such as a spoon, other than the pot, is placed on the heating unit, the iron pot, even when used, is placed far apart from the center of the same, or an abnormal load, such as no load, occurs, thereby inhibiting oscillation of an inverter circuit for induction heating apparatus.

2. Description of the Prior Art

For the purpose of discriminating the proper load condition from the abnormal load condition of the aforesaid improper load, smaller load or no load, an apparatus has hitherto been known which detects an input current and compares it with the predetermined reference level to thereby carry out the above discrimination. Such apparatus, in respect of the input setting for heating possible in a range of 200 to 1200 W, need to be set to the reference level less than 200 W in conformation to the lowest set-input. Hence a problem occurred in that in a case of a larger input set value, the discrimination sensitivity is remarkably low. For example, there has been the problem in that even when the iron pot is shifted from the center of cooking surface during the heating, the increment of input is small, whereby the oscillation of an inverter circuit does not stop. Also, the apparatus, which detects an input to the load, takes considerably much time until the detection and cannot quickly protect a switching element of the inverter circuit or the like, whereby the switching element may have been damaged due to an overload.

The induction heating apparatus, which has solved the above problems, is disclosed in the Japanese Patent Publication No. 44061-1978, which comprises an input adjusting coil of variable inductance connecting in series with an induction heating coil, the input adjusting coil being adapted to be adjusted in association with a circuit element (variable resistor) for setting the reference level. Such construction, however, often suffers the energy loss due to the input adjusting coil, thereby having not at all the practicability.

OBJECT OF THE INVENTION

An object of the invention is to provide an induction heating apparatus which changes corresponding to the load condition the reference level for judging the normality or abnormality of load, so that even when the set input is larger, the abnormality in the load is detectable by a high sensitivity and rapidly and which is of high efficiency without suffering from the energy loss.

Another object of the invention is to provide an induction heating apparatus operable in a stable condition conforming with the set input.

Still another object of the invention is to provide an induction heating apparatus which can discriminate the proper load from the abnormal one even when supply voltage fluctuates.

The above and further objects and features of the invention will more fully be apparent from the following detailed description with accompanying drawings.

DETAILED DESCRIPTION OF THE INVENTION

The induction heating apparatus of the invention is provided with; an input power setting circuit which sets an input power to a load; a pulse width control circuit which outputs a pulse signal to control, on the basis of output of the input power setting circuit, the period for turning on a switching element at an inverter circuit including an induction heating coil; an input power detection circuit which detects an input current to the load; and a load condition detection circuit which compares the pulse signal with the output of input power detection circuit, the result of comparison by the load condition detection circuit discriminating between the normality and abnormality of the load so that when an abnormal load is detected, oscillation of the inverter circuit is inhibited.

Next, an embodiment of the induction heating apparatus of the invention will be concretely described in accordance with the drawings.

Figure 1:
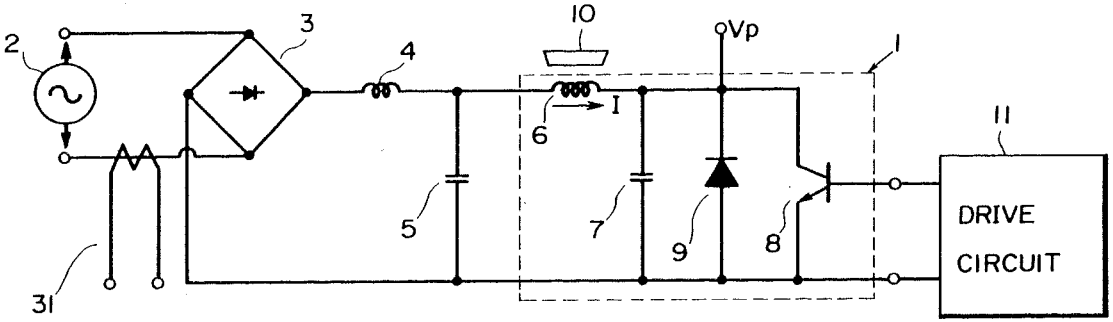
FIG. 1 is a circuit diagram of a power supply circuit portion and an inverter circuit portion of an induction heating apparatus of the invention.

FIG. 1 shows a power supply circuit portion and an inverter circuit of the induction heating apparatus of the invention, in which an alternate current fed from an AC source 2 is rectified by a rectifier circuit 3 and given to the inverter circuit 1 through a choke coil 4 and a smoothing capacitor 5. A current transformer 31 is interposed at the AC side of rectifier circuit 3 so as to detect the input current given to the load or the inverter circuit 1.

The inverter circuit 1 comprises a series resonance circuit of an induction heating coil 6 and a resonance capacitor 7, a transistor 8 connected in parallel to the resonance capacitor 7, and a diode 9 connected in inverse to the transistor 8, so that a cooking pot 10 as the load is placed above the induction heating coil 6 in relation of electromagnetically coupling therewith. The transistor 8 functions as a switching element at the inverter circuit 1 and is controlled of on-off by a pulse signal generated by a drive circuit 11 so that the cooking pot 10 is subjected to heating of the intensity depending upon a ratio of the on-period to off-period.

Figure 2:
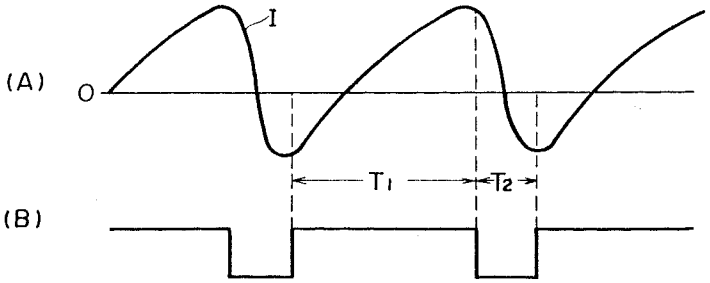
FIG. 2 is a wave form chart showing the relation between a current flowing in an induction heating coil and a control signal for on-off of a switching element.

FIG. 2-(B) shows a pulse signal output by the drive circuit 11, in which the transistor 8 is on for the time period $T_1$ and is off for that $T_2$.

FIG. 2-(A) shows a current I flowing in the induction heating coil 6, in which the direction of current flowing through the transistor 8 is made positive. When the transistor 8 is on, the current I increases in the positive direction and when off, the resonance current by the induction heating coil 6 and resonance capacitor 7 flows for the time period $T_2$, the current in the reverse direction for the time period $T_1$ flowing through the diode 9. Since the current flowing in the induction heating coil 6 changes as abovementioned, a duty ratio is adjusted of its value (to adjust the time period $T_1$ longer or shorter relative to that $T_2$) to thereby enable adjustment of input power.

Figure 3:
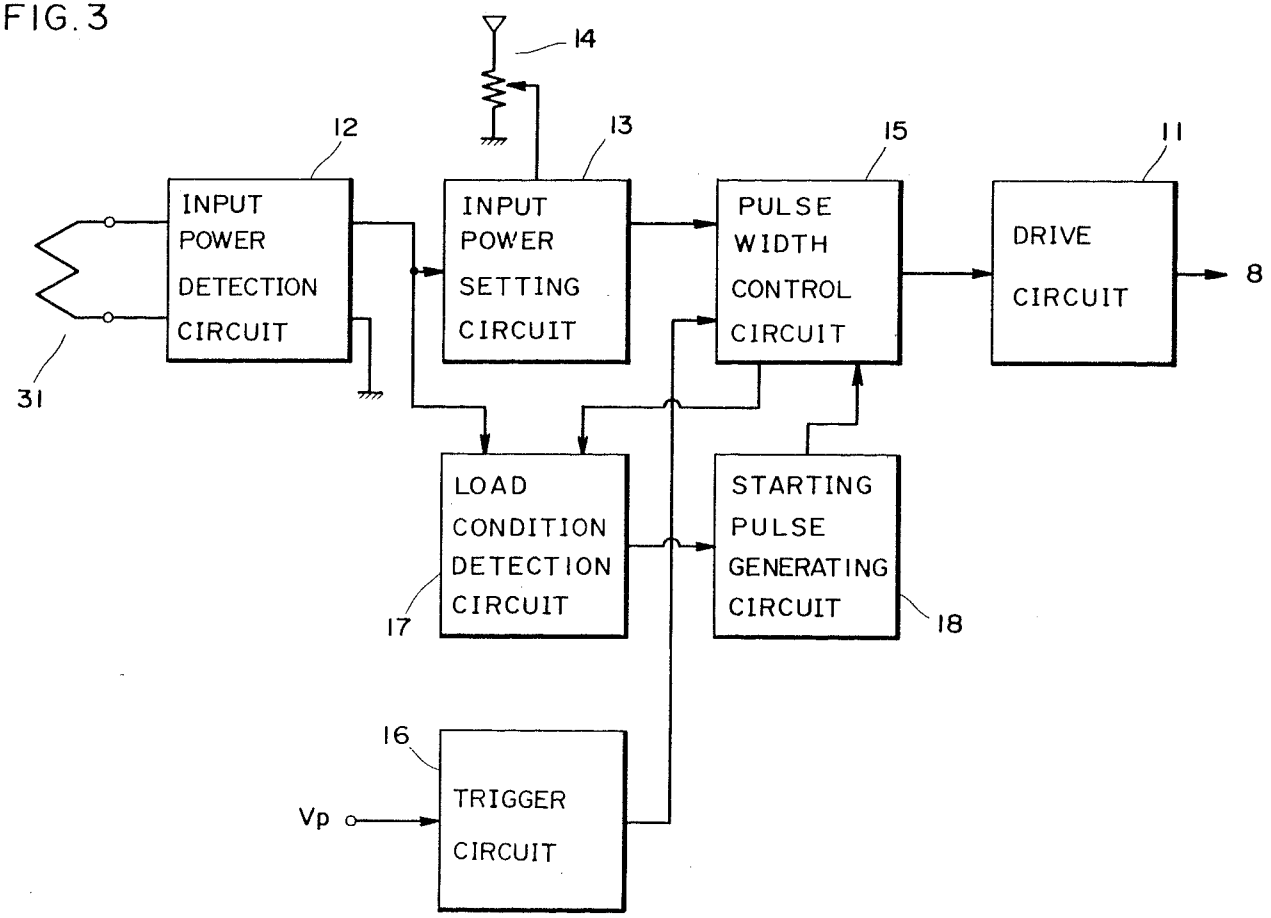
FIG. 3 is a block diagram showing a control circuit portion of the inverter circuit.

FIG. 3 shows a control circuit portion of the inverter circuit 1, in which the current transformer 31 outputs a current corresponding to the input current, which output current is given to an input power detection circuit 12 and converted therein to a voltage signal corresponding to the input current value, the voltage signal being given into a load condition detection circuit 17 and an input power setting circuit 13.

The input power setting circuit 13 makes the voltage signal necessary to coincide an input from the input power detection circuit 12 with an output of a potentiometer 14 in association with an input adjusting dial provided at a control unit of the induction heating apparatus, so that said voltage signal is given into a pulse width control circuit 15. The pulse width control circuit 15 comprises a well-known voltage/frequency converter or pulse width modulation circuit and outputs a pulse signal of duty ratio corresponding to the input voltage, the pulse signal being given to the drive circuit 11, amplified up to the predetermined level, and given to the base of transistor 8. The pulse signal or a signal equivalent thereto, is given to the load condition detection circuit 17.

Reference numeral 16 designates a trigger circuit which is given potential Vp at the node of induction heating coil 6 and resonance capacitor 7 and generates a trigger signal to the pulse width control circuit 15 with the timing for making the potential Vp a level near zero voltage under the predetermined potential, the trigger signal defining the rising timing (the initial point of time period $T_1$) of pulse signal.

The load condition detection circuit 17 converts the input power signal given from the pulse width control circuit 15 into a voltage signal responding to the duty ratio or length of time period $T_1$ and compares the voltage signal with another input: output voltage of input power detection circuit 12, so that the binary output resulting from the above comparison is given to a starting pulse generating circuit 18. The starting pulse generating circuit 18 permits the pulse width control circuit 15 to generate the pulse signal corresponding to the contents of input to the circuit 18, or inhibits the generation of pulse signal.

Figure 4:
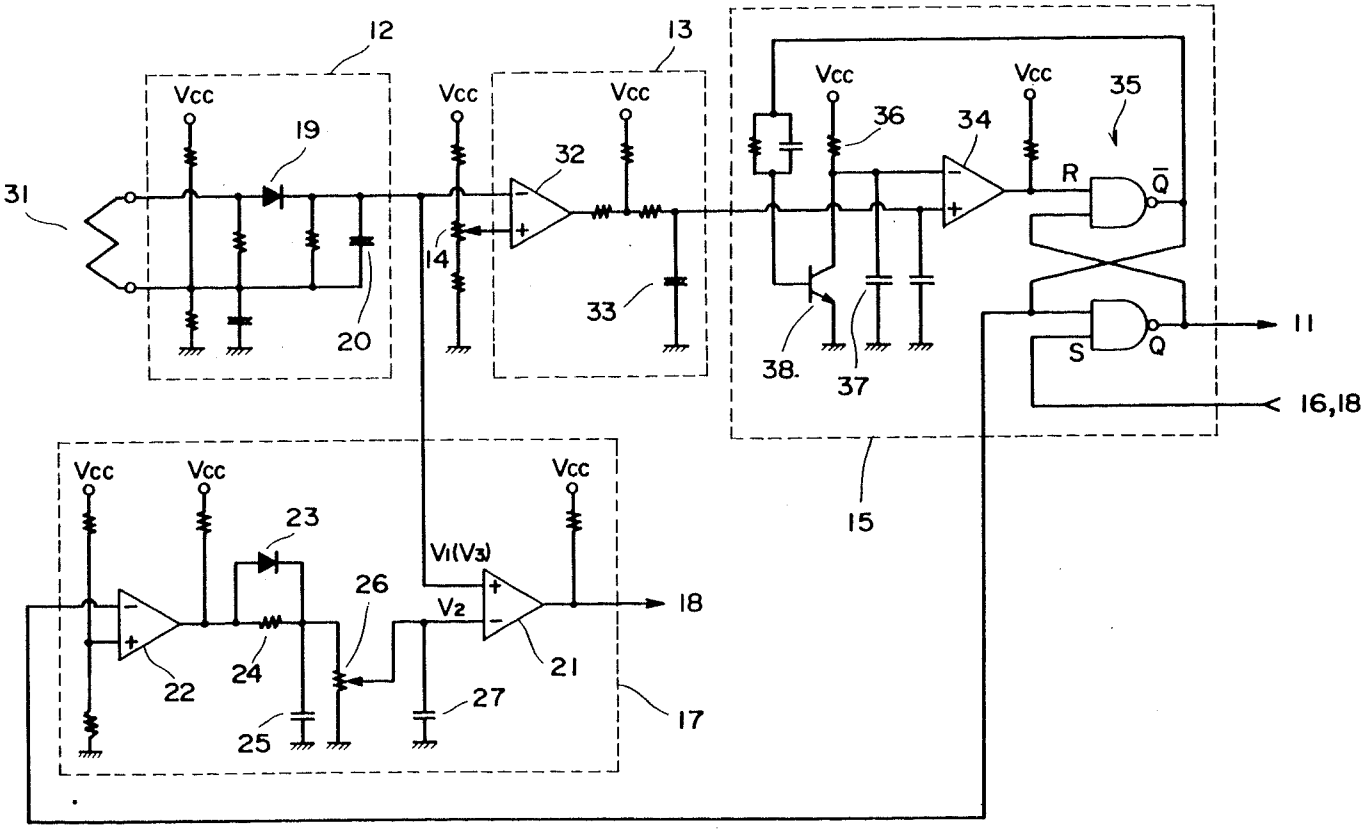
FIG. 4 is a schematic circuit diagram of the principal portion of the control circuit.

Next, explanation will be given on the concrete constructions regarding the control circuit portion at the inverter circuit in accordance with FIG. 4.

Current detected by the current transformer 31 is given to the input power detection circuit 12, half-wave-rectified by a diode 19 thereof, and smoothed by a capacitor 20 to thereby become a voltage signal responding to the input current. The voltage signal is given to the (−) input terminal of an operational amplifier 32 at the input power setting circuit 13 and also to the (+) input terminal of an operational amplifier 21 at the load condition detection circuit 17, the operational amplifier 32 being used as a comparator, the (+) input terminal of which is given an output of potentiometer 14. Hence, the operational amplifier 32 generates a signal which has a high level in a case where the output of potentiometer 14, in other words, the set input is higher than the output of current transformer 31, in other words, the actual input, and has a low level in a case where the same is lower, the output signal of the operational amplifier 32 charging a capacitor 33. Thus, the capacitor 33 responds to charging voltage integrating the binary output of the operational amplifier 32, so that the voltage is given as the control output to the (+) input terminal of an operational amplifier 34 of the pulse width control circuit 15, the output of the operational amplifier 34 being given to the reset terminal R of low active of a R-S flip-flop 35. The operational amplifier 34 is used as a comparator, whose (−) input terminal is given potential at the node of resistor 36 and a capacitor 37 in series connection, the capacitor 37 connecting in parallel to a transistor 38, so that the transistor 38 is on when the $\overline{Q}$ output of the R-S flip-flop 35 has a high level, thereby allowing the capacitor 37 to discharge and the (−) input of operational amplifier 34 to have the ground level. The $\overline{Q}$ output of R-S flip-flop 35 is given to the (−) input terminal of an operational amplifier 22 of the load condition detection circuit 17 and the low active set terminal S of the same is given signals from the trigger circuit 16 and starting pulse generating circuit 18, in other words, the trigger circuit 16, when voltage Vp has a lower level than the predetermined, generates a signal of low level to set the R-S flip-flop 35. Also, in a case where the load condition detection circuit 17 to be discussed below has a low level, the starting pulse generating circuit 18 will constrain the set terminal S of the R-S flip-flop 35 as it is in a high level and constrain the R-S flip-flop 35 in the reset condition, thereby keeping its Q output in a low level. The R-S flip-flop 35 gives its Q output to the drive circuit 11, which turns on the transistor 8 when the Q output has a high level and off the same when it has a low level.

The complementary signal $\overline{Q}$ to such Q output, as abovementioned, is given to the (−) input terminal of operational amplifier 22 of the load condition detection circuit 17, the (+) input terminal of operational amplifier 22 being given constant voltage, the output of the same being inverted to coincide in form with the Q output. The output terminal of the operational amplifier 22 connects with a parallel circuit of the capacitor 25 and potentiometer 26 through a parallel circuit of a diode 23 and resistor 24. Accordingly, during the high level of output of operational amplifier 22, in other words, for the time period $T_1$ where the Q output has a high level and the transistor 8 is on, the capacitor 25 is charged and, while having the low level, is discharged through the resistor 24. Hence, terminal voltage of capacitor 25 is the value responding to the duty ratio of output (Q output of the R-S flip-flop 35) generated by the pulse width control circuit 15 or relative length of time period $T_1$ to that $T_2$. The terminal voltage of capacitor 25 including such information is level-adjusted by potentiometer 26 and smoothed by capacitor 27, thereby being given to the (−) input terminal of operational amplifier 21 used as the comparator. The (+) input terminal of operational amplifier 21 is given output voltage of input power detection circuit 12 so that when the (+) input is higher than (−) input responding to the set input, the operational amplifier 21 generates a high level output. Hence, the starting pulse generating circuit 18, which is given the high level output, permits the set terminal S of the R-S flip-flop 35 to have a low level corresponding to the input from the trigger circuit 16. Conversely, when the (+) input of operational amplifier 21 is lower than the (−) input thereof, the set terminal S of the R-S flip-flop 35, as abovementioned, is constrained at the high level.

In addition, in a case where the signal (Q output) given from the pulse width control circuit 15 to the drive circuit 11 is intended to be given to the load condition detection circuit 17, the input of operational amplifier 22 need only to be inverted of plus and minus terminals.

Next, explanation will be given on the induction heating apparatus of the invention in accordance with FIG. 5.

Figure 5:
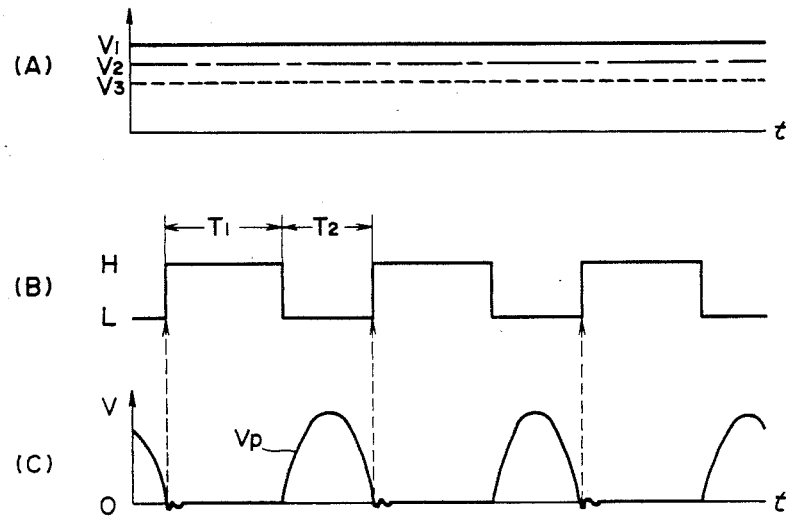
FIG. 5 is a time chart for explanation of the operation.

At first, in a case of normal load, the load, such as the cooking utensil 10 or the like, is given power set by the potentiometer 14, so that the output voltage $V_1$ of input power detection circuit 12, as shown in FIG. 5-(A), is higher than voltage $V_2$ obtained as terminal voltage of capacitor 27 on the basis of complementary signal $\overline{Q}$ to the Q output [FIG. 5-(B)] of the pulse width control circuit 15. Therefore, the output of operational amplifier 21 maintains its high level, whereby the trigger circuit 16 gives the trigger signal at the low level to the R-S flip-flop 35 with the timing for voltage Vp shown in FIG. 5-(C) at a level near zero voltage less than the predetermined voltage. Hence, the pulse width control circuit 15 generates the pulse signal as shown in FIG. 5-(B), so that the transistor 8 is on for the time period $T_1$ wherein the pulse signal has a high level, thereby performing the predetermined heating.

Next, explanation will be given in further detail on the operation of pulse width control circuit 15. Upon setting R-S flip-flop 35, the $\overline{Q}$ output has a low level and the transistor 38 is off. Hence, the capacitor 37 is charged by the time constant depending on a capacity value of the capacitor 37 and a resistance value of the resistor 36, resulting in that the potential at the (−) input of operational amplifier 34 becomes higher than the output voltage [the (+) input] of input power setting circuit 13, whereby the output of operational amplifier 34 turns to have a low level and the R-S flip-flop 35 is reset to put the Q output at the low level. As understandable from such operation, the time period $T_1$ for keeping the Q output at the high level is to be defined by the output of the input power setting circuit 13. Thus, soon after the Q output has a low level, the trigger circuit 16 generates a trigger signal, thereby again putting the R-S flip-flop 35 in a set condition. The above operation is repeated to continue the heating.

On the contrary, in a case where the load condition is abnormal, the output $V_3$ of input power detection circuit 12 becomes lower than $V_2$ [as shown in FIG. 5-(A)] so that the output of the operational amplifier 21 has a low level. Hence, the starting pulse generating circuit 18 makes the set terminal S of the R-S flip-flop 35 have a high level, whereby the Q output has a low level to turn off the transistor 18, thereby protecting the inverter circuit 1. In a case where the load restores to be normal by, for example, correcting the position of cooking pot 10, the output of the starting pulse generating circuit 18 has a low level to set the R-S flip-flop 35, thereby restarting the heating.

Figure 6:
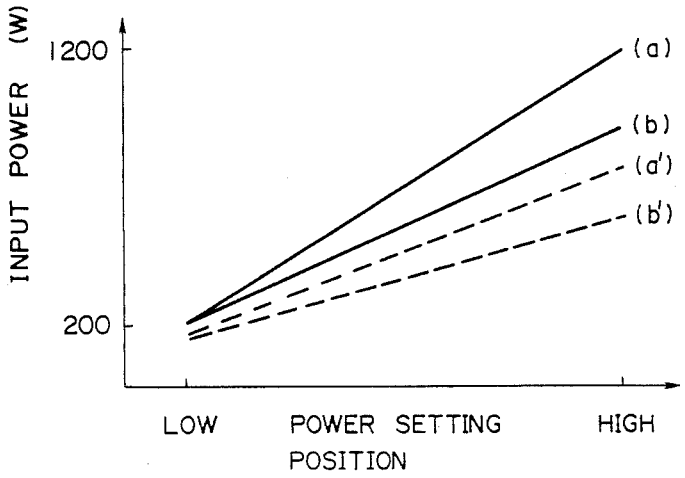
FIG. 6 is a graph showing the relation between the set input and detected input power, the reference level for comparison.

FIG. 6 shows the relation between the power setting position by the potentiometer 14 (axis of abscissa) and the input power (axis of ordinate), in which a continuous line (a) shows the detection input power in the normal load of an enameled pot, and that (b) shows a 18-8 stainless steel pot and a short dashes line (a') shows variation of the load detection reference level ($V_2$) at the enameled pot, and that (b') variation of the same level at the 18-8 stainless steel pot. The load detection reference levels are different in the kinds of load because variation of equivalent resistance and equivalent impedance due to the load changes the rising slope of load current flowing in the transistor 8 and diode 9.

Figure 7:
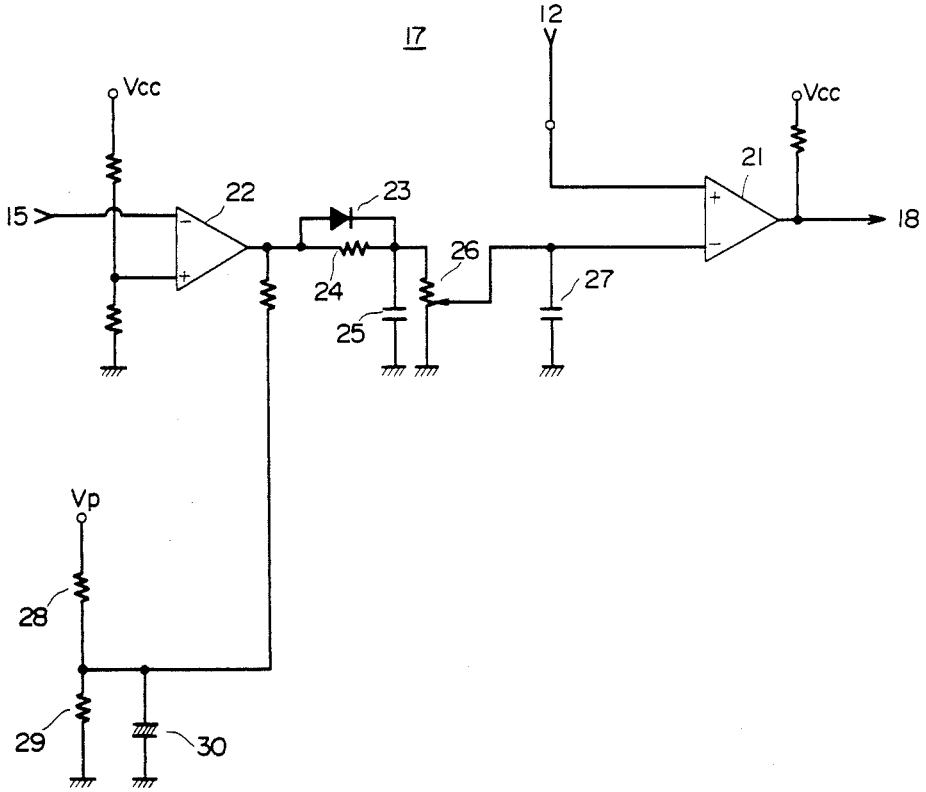
FIG. 7 is a circuit diagram of a modified embodiment of a load condition detection circuit.

FIG. 7 shows a modified embodiment of the load condition detection circuit 17, which is adapted to apply to the output terminal of the operational amplifier 22 voltage Vp divided by resistor 28 and 29 and add, to the same, voltage smoothed by a capacitor 30 connected in parallel to the resistor 29. The voltage Vp changes following variation of supply voltage, thereby being compared accurately with the output of input power detection circuit 12 changing following the same.

As seen from the above, in the induction heating apparatus of the invention, the normality or abnormality of load changes corresponding to the set input power, whereby the abnormality in the load is detectable with high sensitivity and the detection is performable at quick speed. Also, the input power is applied effectively to the heating without waste and the heating can be carried out with high efficiency.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. An induction heating apparatus comprising:

an inverter circuit including a resonance circuit comprising an induction heating coil and a resonance capacitor, and a switching element for energizing said resonance circuit, an input power setting circuit which sets an input power to a load, a pulse width control circuit which generates a pulse signal to control the time period in which said switching element is to be on, on the basis of an output of said input power setting circuit, an input power detection circuit for detecting an input current for the load, and a load condition detection circuit which compares said pulse signal directly with the output of said input power detection circuit, whereby the results of comparison by said load condition detection circuit are used to discriminate between normality and abnormality of the load and when an abnormal load is detected, oscillation of said inverter circuit is inhibited.

2. An induction heating apparatus as set forth in claim 1, wherein said input power setting circuit generates a signal corresponding to a difference between the set signal of said input power setting circuit and the output of said input power detection circuit.

3. An induction heating apparatus as set forth in claim 1, wherein said load condition detection circuit is provided with a circuit which converts said pulse signal into a voltage signal corresponding to the time period when said switching element is on.

4. An induction heating apparatus as set forth in claim 3, wherein said load condition detection circuit is provided with a circuit which adds voltage that changes following variation of supply voltage for said inverter circuit to the voltage signal corresponding to the time period when said switching element is on.

5. An inverter circuit for an induction heating apparatus which includes an induction heating coil and a resonance capacitor comprising:

a switching element for energizing said induction heating coil;

an input power setting circuit which determines the amount of power to be supplied to a load;

a pulse width control circuit which generates a pulse signal to control the time period in which said switching element is to be on, based on the output of said input power setting circuit;

an input power detection circuit which detects an input current for the load and which generates an output signal;

means for comparing said pulse signal with the output signal of said input power detection circuit; and means for discriminating between normal and abnormal loads based on the result obtained from said comparing means and, when an abnormal load is detected, for inhibiting oscillation of the inverter circuit.

6. An inverter circuit for an induction heating apparatus as set forth in claim 5, wherein said comparing means includes means for generating a voltage representing the length of the pulse signal which is compared to the output voltage of the input power detection circuit.

* * * * *

UNITED STATES PATENT AND TRADEMARK OFFICE

CERTIFICATE OF CORRECTION

PATENT NO. : 4,540,866

DATED : September 10, 1985

INVENTOR(S) : Tadao Okuda

It is certified that error appears in the above-identified patent and that said Letters Patent is hereby corrected as shown below:

Title page:

Tadao Okuda is the correct spelling of the inventor's name.

Signed and Sealed this

*Twenty-fifth* Day of *February 1986*

[SEAL]

*Attest:*

DONALD J. QUIGG

*Attesting Officer*

*Commissioner of Patents and Trademarks*